US006280143B1

(12) United States Patent
Parker et al.

(10) Patent No.: US 6,280,143 B1
(45) Date of Patent: Aug. 28, 2001

(54) BLADE FOR FLUID PUMP

(75) Inventors: Darcy Kenneth Parker, Whitby; Wayne Ernest Conrad, Hampton, both of (CA)

(73) Assignee: Fantom Technologies Inc., Welland (CA)

( * ) Notice: Subject to any disclaimer, the term of this patent is extended or adjusted under 35 U.S.C. 154(b) by 0 days.

(21) Appl. No.: 09/450,758

(22) Filed: Nov. 30, 1999

(51) Int. Cl.[7] ..... B63H 1/16
(52) U.S. Cl. ..... 416/186 R
(58) Field of Search ..... 416/186 R, 188

(56) References Cited

U.S. PATENT DOCUMENTS 489,159 * 1/1893 Hyde ..... 416/186 R X
3,875,279 * 4/1975 Kaelin ..... 416/186 R X

FOREIGN PATENT DOCUMENTS

361209 * 7/1938 (AT) ..... 416/188
2713636 * 7/1978 (DE) ..... 416/186 R
971935 * 1/1951 (FR) ..... 416/188
246327 * 6/1969 (RU) ..... 416/186 R
1273650 * 11/1986 (RU) ..... 416/188

* cited by examiner

*Primary Examiner*—John E. Ryznic
(74) *Attorney, Agent, or Firm*—Philip C. Mendes da Costa; Bereskin & Parr

(57) ABSTRACT

A blade for use with a housing to comprise a motor driven pump to be used to pump fluids. In particular, the blade is particularly useful because of high efficiencies in vacuum pumps, particularly, household vacuum cleaners having motors which may be advantageously powered using batteries. The blade involves a pair of generally conical walls enclosing therebetween a plurality of fluid flow passages. The fluid flow passages are defined in part by vanes extending between the two generally conical walls. The blade has a generally axial inlet and imparts centrifugal force to fluid elements. Because of the conical shape, the fluid moves in a direction having tangential components imparted by the vanes, radial components arising from centrifugal force and axial components because of the conical wall structure.

High efficiencies are obtained by contouring the generally conical walls in different planes, including convex curves in planes containing the axis of rotation and concave curves in polar planes concentric with the axis of rotation.

16 Claims, 7 Drawing Sheets

BLADE FOR FLUID PUMP

FIELD OF THE INVENTION

This invention relates to rotary devices, particular blades, to be used as fans or pumps for fluids including air, which move fluids using centrifugal principals. In particular, the invention relates to a blade to be used as a fan or pump for moving gases. More particularly, the invention relates to a blade which may conveniently be used in a suction device, more particularly a vacuum cleaner.

BACKGROUND OF THE INVENTION

There are several types of pumps which may be used to move fluids. Basically the same type of pumps can be used for fluids which may be either liquid or gaseous. Among the many types of pumps available for such purposes are pumps which cause the fluids to move using centrifugal principals. In a pump based on centrifugal principals, a blade is provided which rotates about an axis. The blade normally includes one or more walls which are generally symmetrical about an axis so that the pump can rotate in a balanced fashion. The blade will include one or more vanes which extend radially outwardly from an inlet to an outlet. Typically the inlet is located substantially symmetrically with respect to the axis and the outlet will be an outer circumferential edge of the blade. As the blade rotates, particles of the fluid are also caused to move tangentially with respect to the axis of the blade. As the vanes cause the particles of fluid to move tangentially, centrifugal force causes the particles to move radially outwardly toward the outlet. Such devices are well-known and are referred to as centrifugal pumps.

Centrifugal pumps have found widespread usage for fluids of various kinds. Centrifugal pumps are often used as water pumps and can be used to move large volumes of water. Centrifugal pumps are also used in many applications for gases and in particular ambient air. Typically a vacuum cleaner will make use of a centrifugal blade. The negative pressure at the inlet is used as a vacuum source to remove dirt and dust from the article being vacuumed.

Centrifugal blades of this type are particularly useful in moving relatively large volumes of fluid. Centrifugal pumps are not normally the device of choice where very high ranges in pressure are required. When higher pressures are required, resort is often had to piston pumps, gear pumps or other positive displacement pumps.

Most centrifugal blades move the fluid being pumped in a direction which is substantially radial only. The blade is housed within a shroud to direct fluid flow as desired. The pump comprising the blade and its shroud is then driven by a motor. Typically the motor shaft is attached to one of the walls of the blade. As long as the wall of the blade to which the drive shaft is attached is substantially planar, the length of the drive shaft between the locations of fixation to that wall and the motor can be conveniently short.

Theoretical considerations have also given rise to a type of pump some times referred to as a combined flow or mixed flow pump. In a mixed flow device, the blade is provided with a taper so that the fluid particles moved by the vanes move in a direction which is primarily tangential and radial, but which also includes a component which is axial, that is the fluid particles move in a direction having a component which is parallel to the axis of rotation of the blade. Such blades are not generally well accepted, as the blade must then have an increased axial length as compared with a blade of similar diameter which imparts only tangentialradial flow to the fluid being moved. This in turn means that the motor must be positioned farther from the surface of the blade to which the drive shaft is attached. Lengthening the drive shaft creates a greater mass of rotating material as well as increasing stability problems arising from the se of the greater overall length of the pump and motor unit. This in turn ay call for additional bearing structures.

Centrifugal fans of the pure tangential radial type are thus the referred choice. Pumps of this type have been well accepted and are widely used, particularly in the vacuuming industry for household vacuums. In most household vacuums, a motor is fitted to the blade for driving the blade. The motor typically operates off household current and a cord is provided. One of the draw backs of this type of arrangement is that the vacuum cleaner can only be used at a distance from the supply of household current determined by the length of the cord. This means, as the vacuum is used to clean a larger area, the cleaner must shut off the vacuum from time to time, unplug the cord and move the cord to another outlet within the next area to be cleaned so that all portions of the desired area can be reached within the limitations provided by the cord length. It is inconvenient to provide excessively long cords as the cord itself then becomes more trouble to handle in order that it be kept coiled and uncoiled as necessary, depending upon the length from the outlet.

Various attempts have been made to create household vacuums which operate on battery or other portable power. Such devices are particularly useful in small hand held size for doing light cleaning jobs. In such units, power is often provided by on-board batteries which may be of a rechargeable nature. The vacuum operates for a relatively short period of time, perhaps five to ten minutes, and a relatively low powered vacuum pump is included. The unit may then be moved from place to place providing low power vacuum over a relatively short period.

SUMMARY OF THE INVENTION

It would be desirable to have a vacuum which more closely approaches the performance of the typical vacuum working on household current. This can be provided using known rotors and known batteries. However, the time through which such a vehicle may operate before recharging is required becomes a function of the battery size. As battery size increases, so does the weight of the vacuum and a point is reached at which the vacuum is no longer of convenient size and manoeuvrability to be used by the average household cleaner. Accordingly, battery size is limited by these factors. Once it is realized that the battery size is limited, then it becomes more important to increase the efficiencies otherwise present in the pump. Thus, there is a need to provide a type of pump which provides an acceptable suction parameters while requiring decreased power for operation. This in turn would then provide for a longer cycle between charging.

In accordance with this invention, an improved blade for use with a motor for moving fluid to create a fluid suction device comprises a generally conical shape. The blade comprises a first generally conical wall having a first inner surface and a first outer surface. The blade further comprises a second generally conical wall having a second inner surface and a second outer surface. The blade further comprises a plurality of vanes which extend between the first and second walls to define a plurality of fluid flow channels between the first and second walls and adjacent pairs of the vanes. The first and second generally conical walls have a common general axis of rotation. The blade has a fluid inlet for the plurality of fluid flow channels which is located substantially on said axis. The blade also has a fluid outlet for the plurality of fluid flow channels which is located radially outwardly of the axis and which is located axially spaced from the inlet with respect to the axis so that fluid flowing into the fluid flow channels moves radially outwardly and axially along with respect to the axis.

In another embodiment of the invention, a blade for a fluid flow pump is generally conical shaped. The blade has a first generally conical wall having a first inner surface and a first outer surface. The blade also has a second generally conical wall having a second inner surface and a second outer surface. The blade also has a plurality of vanes extending between the first and second walls to define a plurality of fluid flow channels between the inner and outer walls and adjacent pairs of the vanes. The first and second generally conical walls have a common general axis of rotation. The blade has a fluid inlet for the plurality of fluid flow channels which is located on the axis. In addition, the blade has a fluid outlet for the plurality of fluid flow channels which is located radially outwardly of the axis and which is located axially spaced from the inlet with respect to the axis so that fluid flowing in the fluid flow channels will move radially outwardly and axially along with respect to the axis. In the blade at least one of the first inner surface and the second inner surface is curved in a plane containing the axis.

In another embodiment of the invention at least one of the first inner and second inner surfaces is curved in a polar plane with respect to said axis and said curve is concave when viewed from the inside of the flow channels.

In a further preferred embodiment of the invention, the cones of the generally conical walls have different angles with respect to the axis of rotation.

DETAILED DESCRIPTION OF THE DRAWINGS

Further and other features of the invention will become apparent from review of the following description of preferred embodiments of the invention, and in which.

Figure 1:
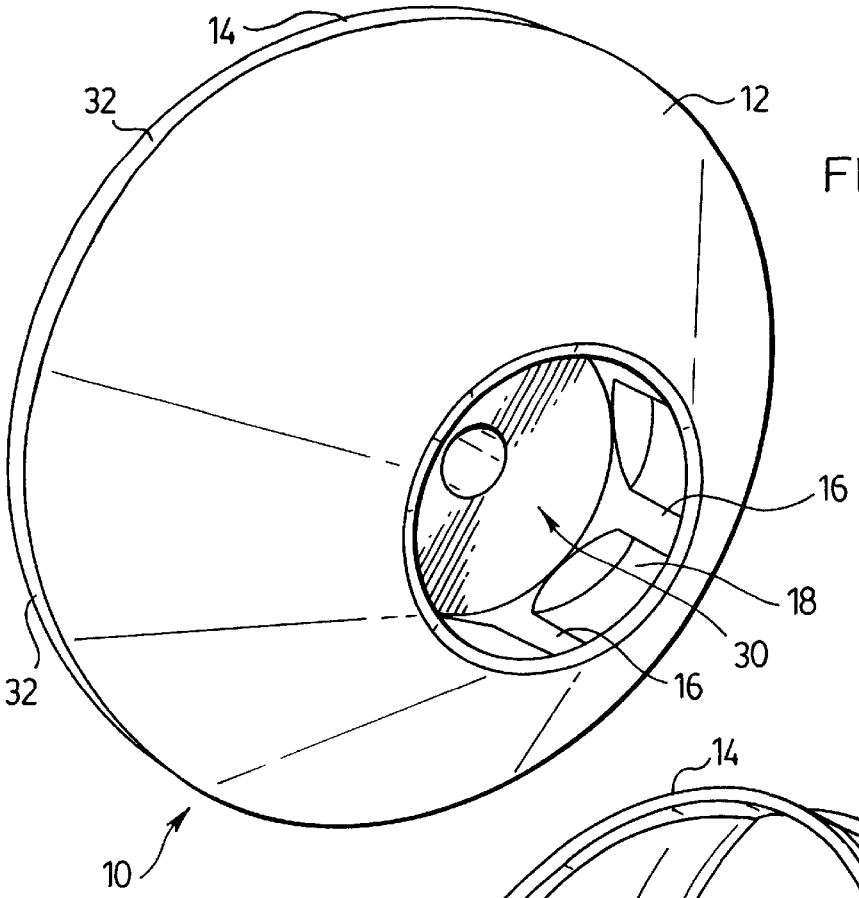
FIG. 1 is a perspective view of a blade in accordance with the invention.

FIG. 1 illustrates a blade shown generally as 10. The blade 10 is generally conical shaped and comprises a first generally conical wall 12 and a second generally conical wall 14. The blade 10 also comprises a plurality of vanes 16. The walls 12 and 14, together with adjacent pairs of vanes 16, define a plurality of fluid flow channels 18. The blade 10 is intended to rotate to act to impart centrifugal energy to fluid within flow channels 18. The blade 10 has a general axis of rotation illustrated by the dotted line 20. The first generally conical wall 12 and the second generally conical wall 14 are coaxially arranged with respect to the axis 20. The blade has a fluid inlet 30 and a plurality of fluid outlets 32.

Figure 2:
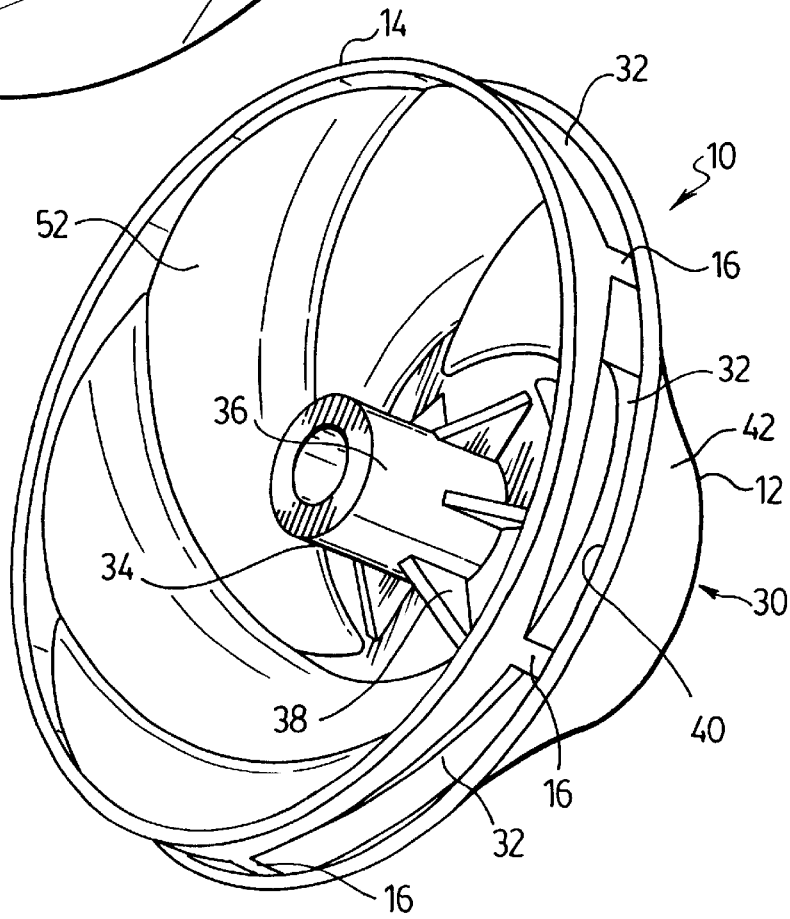
FIG. 2 is a perspective view of the blade of FIG. 1 taken from the rear.

From reference to FIG. 2, it will be realized that second wall 14 comprises a hub 34. The hub 34 is a generally cylindrical structure which is co-axial with the axis 20 and serves to attach a drive shaft to the blade 10. In order to use the blade 10, the blade is mounted in a shroud or housing which encloses the blade 10. The shroud is not shown as the shroud itself does not form part of this invention. The shroud will be shaped so as to efficiently direct air toward the fluid inlet 30. The shroud in addition, may be shaped to direct fluid from the plurality of fluid outlets 32 in a manner as desired. The blade illustrated in the drawings is suited for use in a domestic vacuum cleaner. The air drawn into the inlet in such an installation will first have passed through a cleaning nozzle and then through a dirt separation and capture structure such as a filter or cyclone. The clean air is then drawn through the blade 10. Air from the plurality of outlets 32 or at least a portion thereof may then be directed over the electrical motor driving the blade so as to cool the electrical motor as required. The air handled by the blade 10 may then be ducted to the atmosphere or to some other use as desired.

Figure 5:
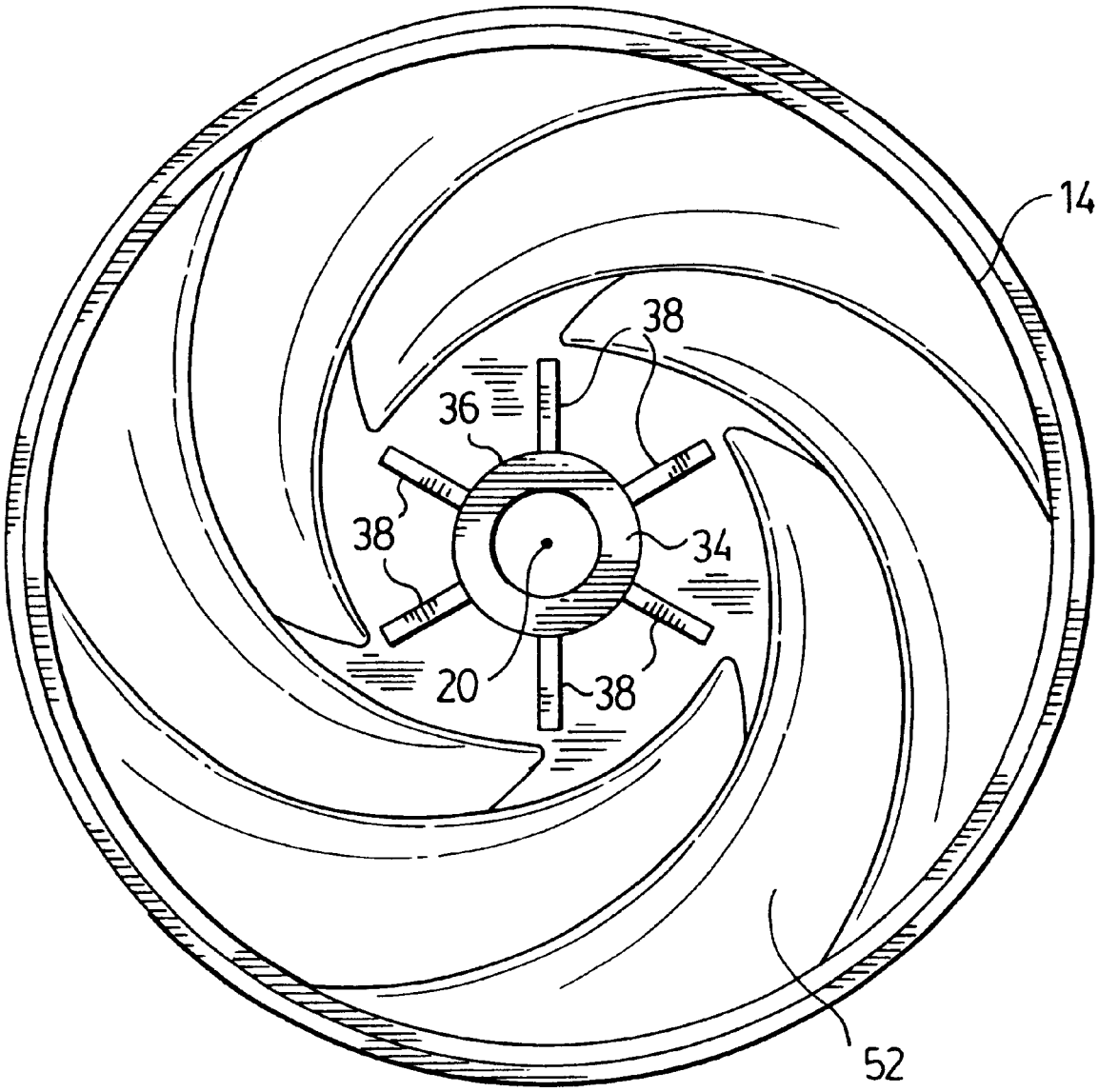
FIG. 5 is a rear view of the blade of FIG. 1.

FIG. 5 illustrates the blade from the rear looking along the axis 20. The hub 34 includes a substantially cylindrical wall 36. The hub 34 advantageously comprises a plurality of stiffening ribs 38 as shown in FIG. 5. In FIG. 5 there are six stiffening ribs 38 which serve to connect the wall 36 to the wall 14. The hub 34 including its cylindrical wall 36 and stiffening ribs 38 transfers all of the drive force to the blade 10.

Figure 6:
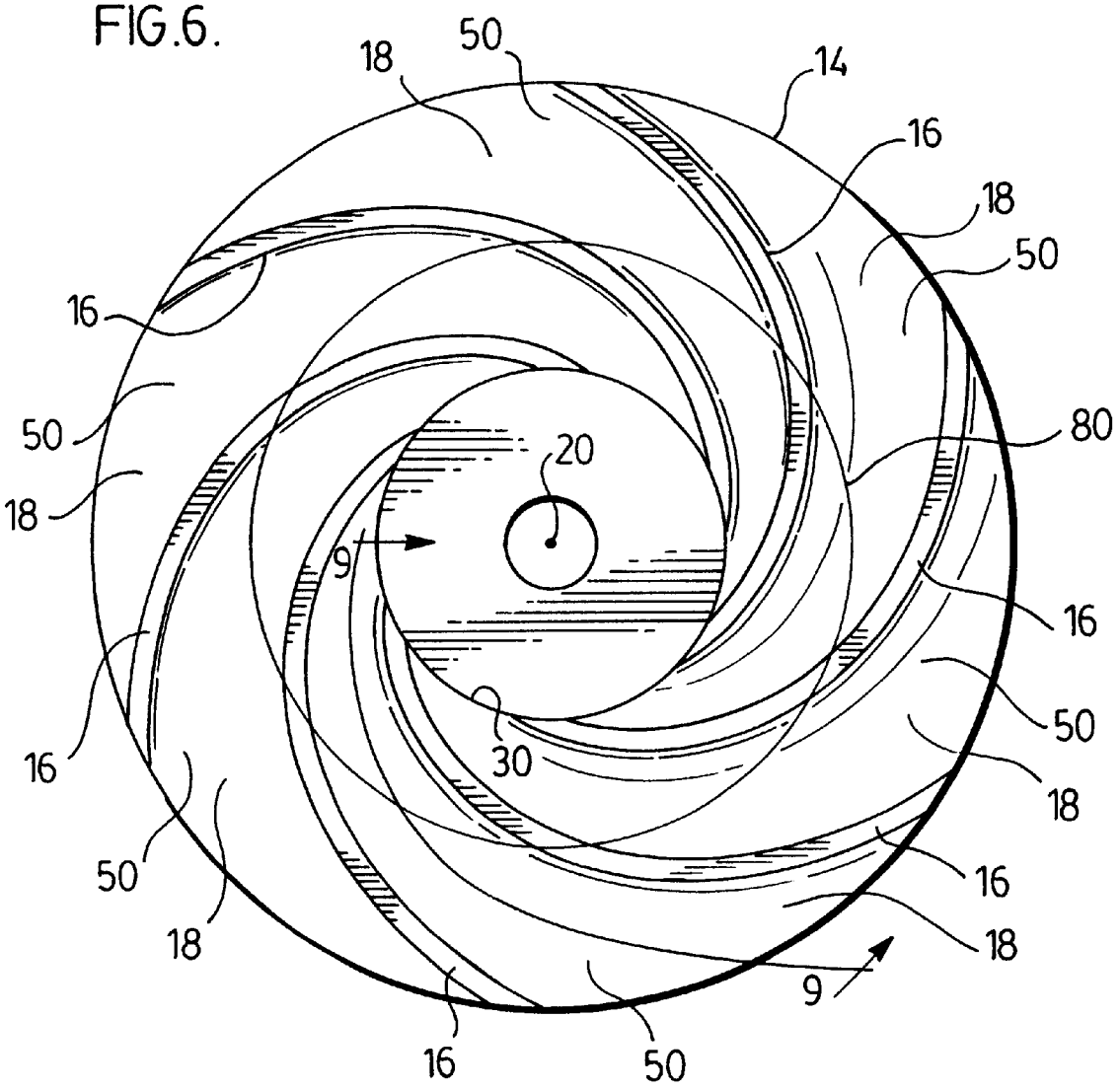
FIG. 6 is a top view of the blade of FIG. 1, with one of the walls removed.

FIG. 6 illustrates the interior of the blade 10. FIG. 6 is a drawing of the second generally conical wall 14 and the plurality of vanes 16 but with the first conical wall 12 removed so as to show the internal configuration. It will be observed that each of the vanes 16 is curved in a substantially spiral shape to provide efficient air flow along the fluid flow channels 18.

From reference to FIG. 2, it will be noted that the first generally conical wall 12 has a first interior surface 40 and a first exterior surface 42. Similarly, the second annular wall 14 has a second interior surface 50 illustrated in FIG. 6 and a second exterior surface 52.

Each fluid flow channel 18 is defined by the first interior surface 40 of the first conical wall 12, the second interior surface of the second conical wall 14 and two adjacent vanes 16. The vanes 16 extend between the first conical wall 12 and the second conical wall 14. Thus, as the blade 10 is rotated, fluid within any one of the fluid flow channels 18 is caused to move in a tangential direction by rotation of the vanes 16. The vanes 16 move the fluid in a tangential direction with respect to the axis. As the fluid is not confined circumferentially, the fluid will move radially with respect to the axis 20 as is commonly understood in connection with centrifugal pumps. However, the fluid is also caused to move in an axial direction as the fluid passes from the inlet to the plurality of outlets by the generally conical shape of the first conical wall 12 and the second conical wall 14. Thus, the fluid within each fluid flow channel 18 will move in directions having tangential, radial and axial components.

As will be explained below, it is not necessary that the first interior surface 40 and the first exterior surface 42 of the first conical wall 12 have the same precise shape. Similarly, the second interior surface 50 and the second exterior surface 52 of the second generally conical wall 14 need not have precisely the same configuration. In this disclosure and throughout the claims, the first and second generally conical walls 12 and 14 and the interior and exterior surfaces 40, 50, 42 and 52 respectively are all referred to as being generally conical without intending to limit the configuration to precise conical or part conical configurations.

Figure 7:
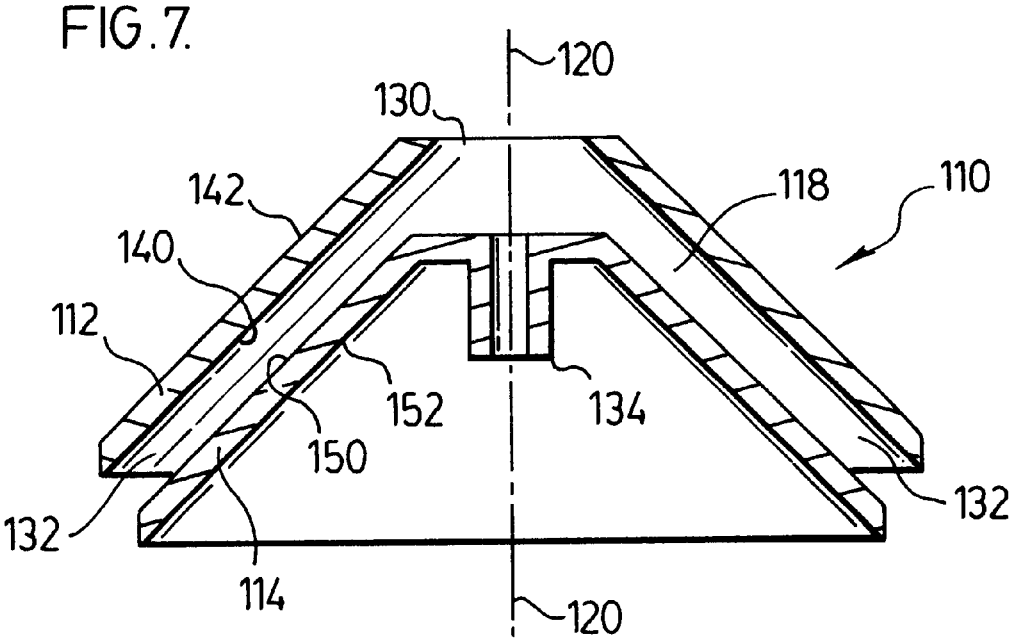
FIG. 7 is a cross-sectional view of an alternate embodiment of the invention.

The operation of the blade will now be more clearly understood by reference to the part cross-sectional views of various embodiments of the invention illustrated in FIGS. 7 through 17. FIG. 7 is a cross-section of a flat plane containing the axis 20 and illustrates a simplified blade 110. Similar numbering has been used with the prefix 1. Blade 110 has a first conical wall 112 and a second conical wall 114. The first conical wall 112 has a first interior surface 140 and a first exterior surface 142. The second generally conical wall 114 has a second interior surface 150 and a second exterior surface 152. The second generally conical wall 114 has a hub 134. The blade 110 has a general axis of rotation 120. The blade has an inlet 130, a plurality of fluid flow chambers 118 and a plurality of outlets 132.

The blade 110 further comprises a plurality of vanes which are not shown for purposes of clarity in the cross section illustrated in FIG. 7. FIG. 7 illustrates, however, that the first generally conical wall 112 is in the form of a truncated cone. That is, in the cross-section illustrated in FIG. 7, the first interior surface 140 is illustrated as a straight line. Similarly, the second conical wall 114 is also shown as a truncated cone and second interior surface 150 is also a straight line. Each of the first and second generally conical walls 112 and 114 respectively, have the same cone angle. That is, the distance between the first interior surface 140 and the second interior surface 150 for each of the flow channels 118 for this blade measured transverse to the axis 20 is constant from the fluid inlet 130 to the plurality of fluid outlets 132.

Figure 8:
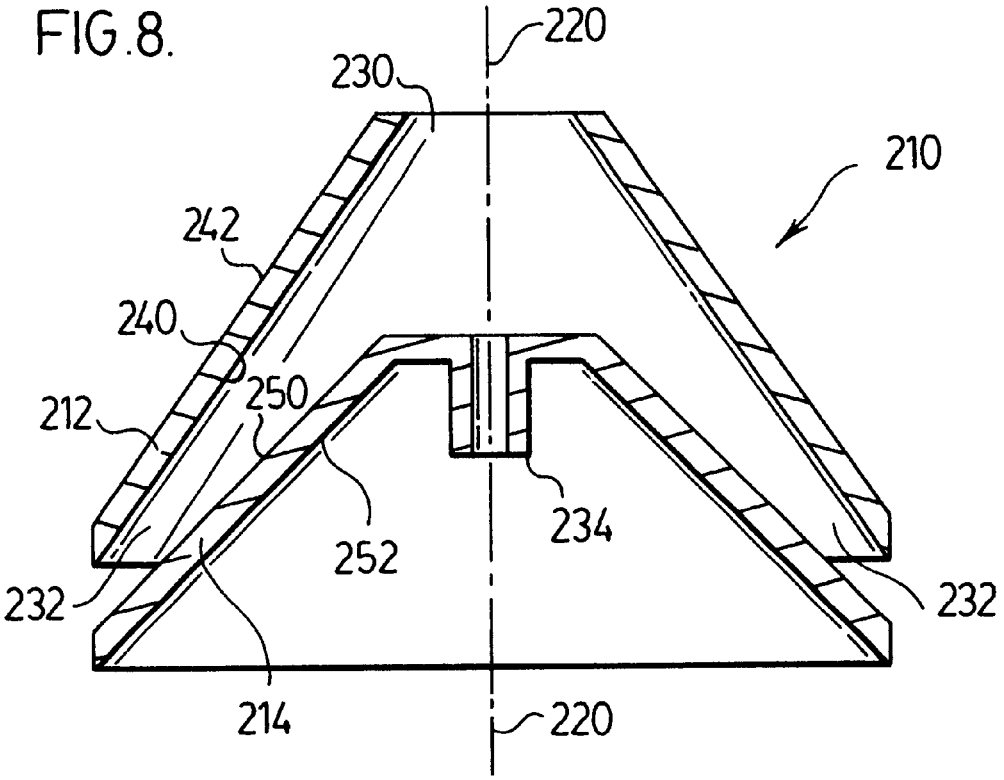
FIG. 8 is a cross-sectional view similar to FIG. 7 of a further embodiment of the invention.

FIG. 8 is a view similar to FIG. 7. FIG. 8 illustrates an alternate embodiment of the invention. Similar numbers have been used with the prefix 2. Thus, the blade 210 includes a first generally conical wall 212 having a first interior surface 240 and a first exterior surface 242. The blade 210 also includes a second conical wall 214 having a second interior surface 250 and a second exterior surface 252 along with a hub 234. The principal difference between the blade 110 illustrated in FIG. 7 and the blade 210 illustrated in FIG. 8 is that the cone angles of the conical walls 212 and 214 with respect to the axis of rotation 220 are not the same. The cone formed by the wall 212 is steeper than the cone formed by the wall 214. In the embodiment illustrated in FIG. 8, the first interior surface 240 and the second interior surface 250 are each conical surfaces and thus are shown as straight lines in this cross-sectional view. The distance between the first interior wall 240 and the second interior wall 250 measured transverse to the axis 220, diminishes from the inlet 230 to the plurality of outlets 232.

Figure 9:
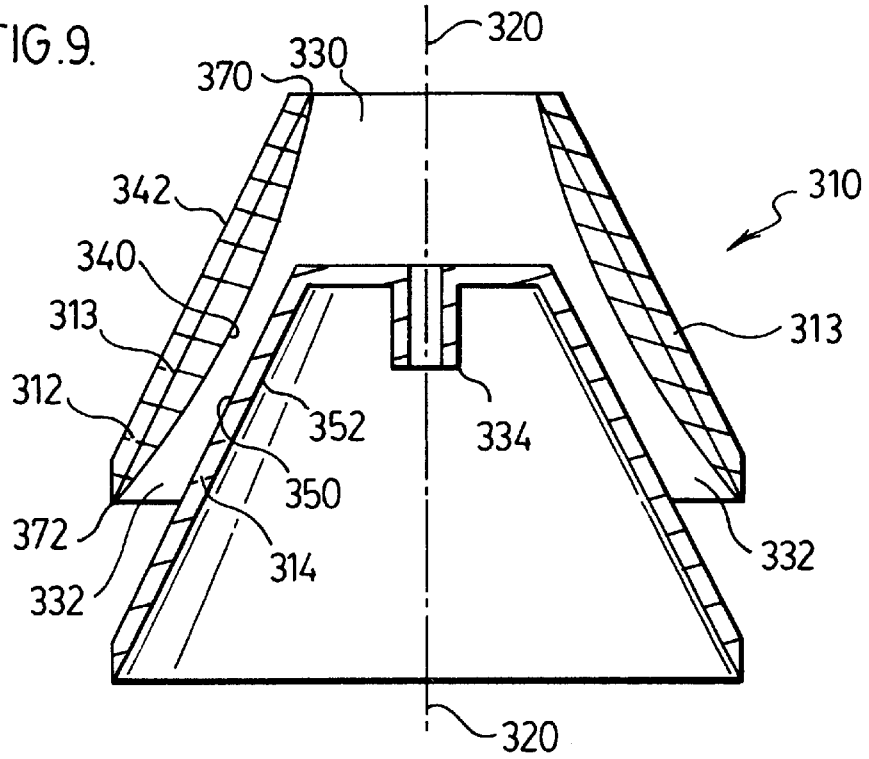
FIG. 9 is a cross-sectional view similar to FIGS. 7 and 8 of he blade of FIG. 1.

FIG. 9 is similar to FIGS. 7 and 8 and illustrates a further alternate embodiment of a blade 310. In this embodiment, the blade 310 comprises a first generally conical wall 312 having a first interior surface 340 and a first exterior surface 342. The blade 310 also includes a second generally conical wall 314 having a second inner surface 350 and a second exterior surface 352, along with a hub 334. The blade 310 has a fluid inlet 330 and a plurality of fluid outlets 332.

In FIG. 9, the second generally conical wall 314 is shown as having a conical shape. Thus, the second interior surface 350 is shown as a straight line in this view. However, differing from the blades illustrated in FIGS. 7 and 8, in blade 310 illustrated in FIG. 9, the first interior surface 340 of the wall 312 is shown as a curved surface. To more clearly illustrate the curve, a straight line between the inlet and outlet has been shown in the wall 312 and is marked in the drawing by the line 313. The length of line 313 between point 370 on the inlet and point 372 on the outlet is less than the shortest distance along surface 340 between those same points. Surface 340 is a surface which is smoothly curved and is convex when viewed from the interior of the fluid flow channel 318. The use of the terms "smooth" and "convex" is intended to mean in this specification and claims that every element of the curve is convex but that the radius of curvature at any element of the curve can be different. The curve however is a smooth curve in that every finite length of the curve is convex over that finite length. Thus the convex curve could be hyperbolic or parabolic for example, or have another or irregular shape.

Figure 9B:
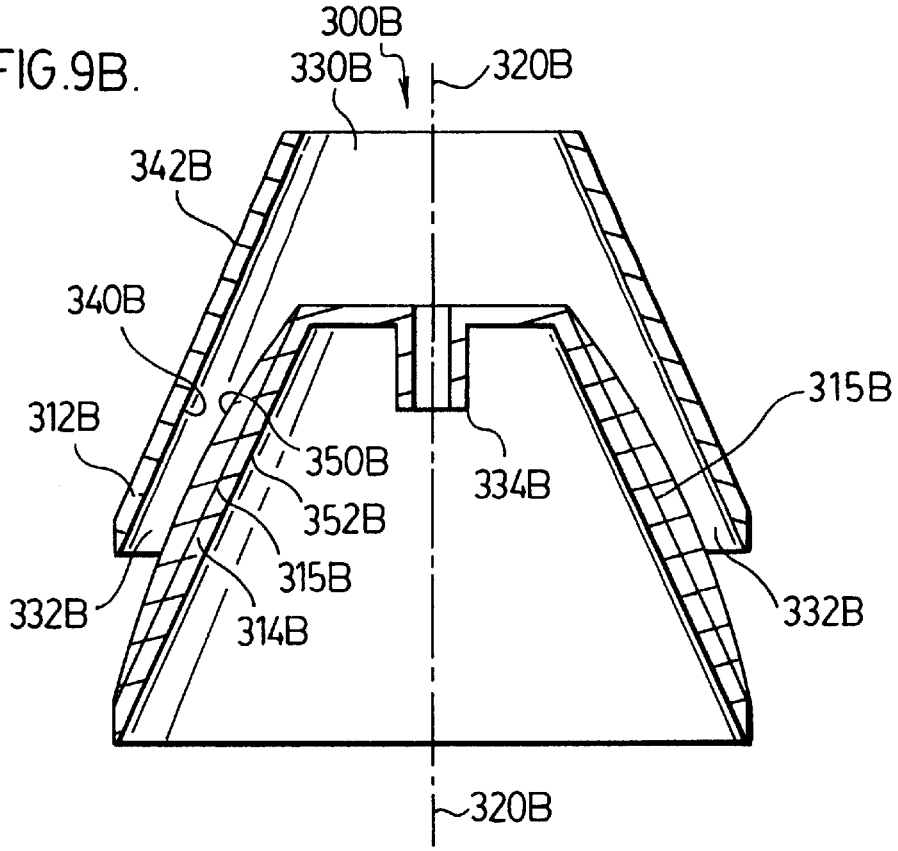
FIG. 9B is similar to FIG. 9 showing another embodiment f the invention.

In FIG. 9, the surface 340 is smoothly curved convexly while surface 350 is conical and is shown as a straight line. In an alternate embodiment of the invention illustrated in FIG. 9B, the surface 350B may be smoothly convexly curved and surface 340B could be conical. The curve of surface 350B is convex as shown by the straight line 315B. In other embodiments both inner surfaces may be smoothly convexly curved. The reason one or more such convex curves is advantageous in that this provides the designer with alternate ways of keeping the area of the cross section of the flow channel uniform. The area of the cross-section of the flow channel is advantageously uniform to reduce energy losses in the flow patterns within the fluid flow channels. As the fluid moves radially outwardly the width of the channel increases as the circumference of the blade increases and a uniform area can be achieved by reducing the height. Use of different cone angles as illustrates in FIG. 8 assists in this regard as does convexly curving one or more of the inner surfaces as shown in FIG. 9.

It has been found that there are substantial gains in efficiency as compared to the planar, that is, typical centrifugal blade. A mixed flow blade comprising two cones of similar cone angle such as shown in FIG. 7 for equal watts input to a motor gives a higher flow rate of air with only slightly lower pressure loss across the blade. A blade of the type shown in FIG. 8 has about the same air flow as that of FIG. 7 but with improved pressure loss to give increased efficiency for equal power input. The device shown in FIG. 9 gives even better efficiency, that is, even less pressure loss for equal air flow and equal power input. The device shown in FIG. 9 gives even better efficiency that is even less pressure loss for equal air flow and equal power input.

We have also found that further substantial efficiency gains may be made by further altering the configuration of the inner surfaces 40 or 50 or both. The blade 10 illustrated in FIGS. 1 through 6 is provided with an additional curved surface 50. The surface 50 is curved to present an outwardly curving surface or concave surface for the surface 50 between adjacent pairs of vanes 16 when viewed from within the flow channel 18.

Figure 3:
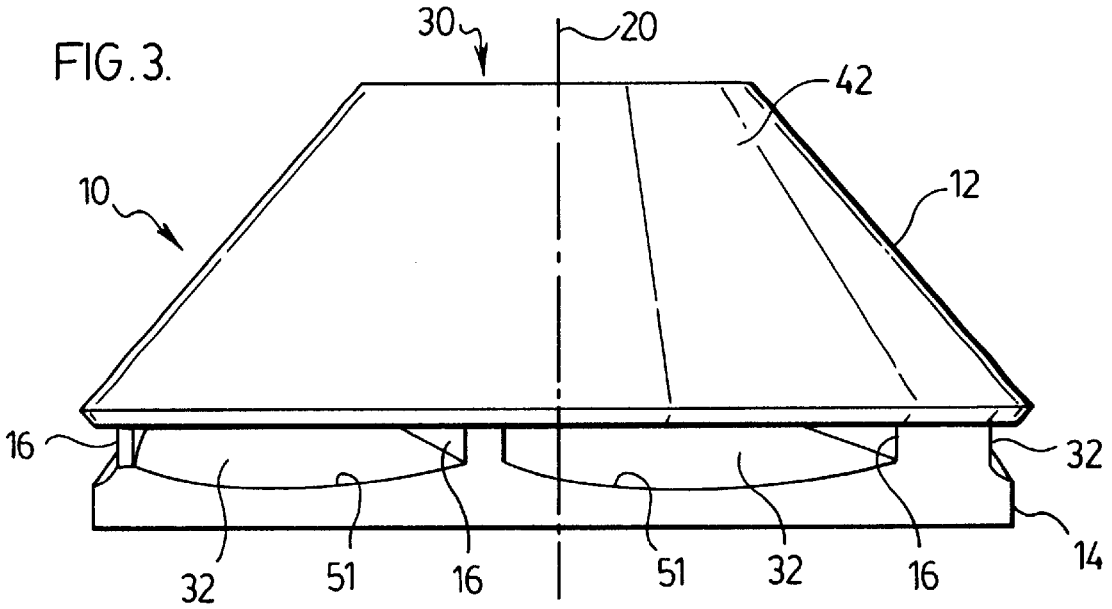
FIG. 3 is a side view of the blade of FIG. 1.
Figure 4:
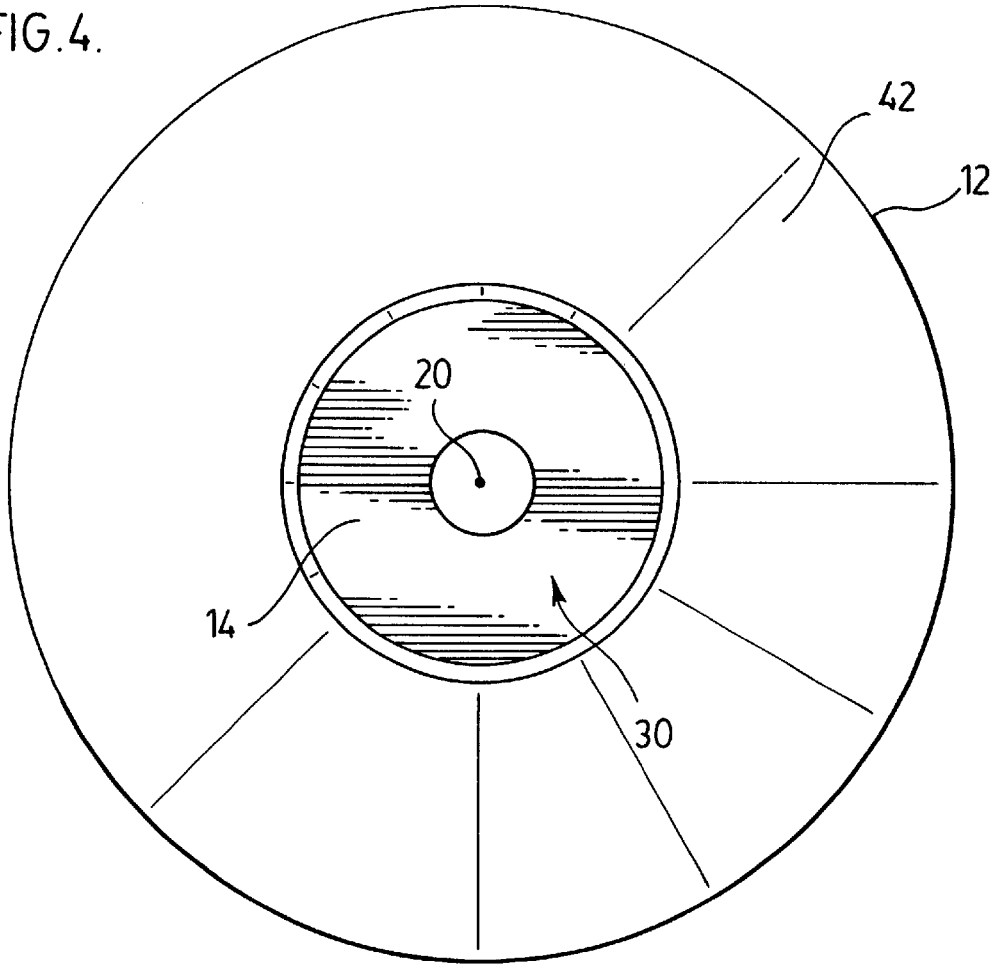
FIG. 4 is a top view of the blade of FIG. 1.

The concave surface is most clearly illustrated in FIG. 3. At the outlet 32 illustrated in FIG. 3, it will be observed that the second interior surface 50 terminates in a line marked 51 at the fluid outlet 32. The line 51 represents a curve extending between adjacent vanes 16 so that the surface 50 within the fluid flow channel 18 is concave. That is, it curves outwardly with respect to the interior of fluid flow channel 18.

Figure 10:
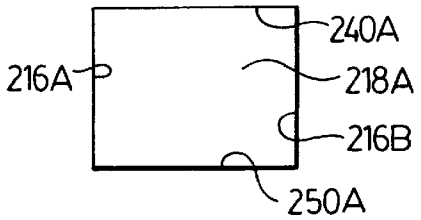
FIG. 10 is a polar cross-section of a portion of the flow path of the embodiment illustrated in FIG. 8.
Figure 11:
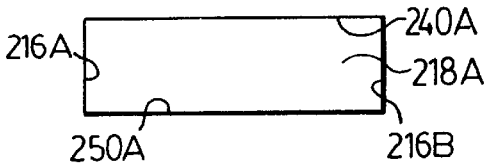
FIG. 11 is a polar cross-section of a portion of the flow path of the embodiment illustrated in FIG. 8.
Figure 12:
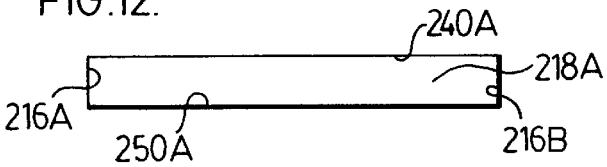
FIG. 12 is a polar cross-section of a portion of the flow path of the embodiment illustrated in FIG. 8.
Figure 13:
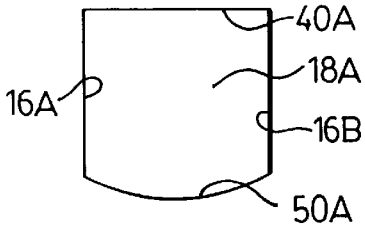
FIG. 13 is a polar cross-sectional view similar to FIG. 10 of the blade of FIG. 1.
Figure 14:
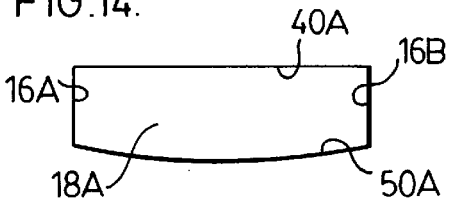
FIG. 14 is a polar cross-sectional view similar to FIG. 11 of the blade of FIG. 1.
Figure 15:
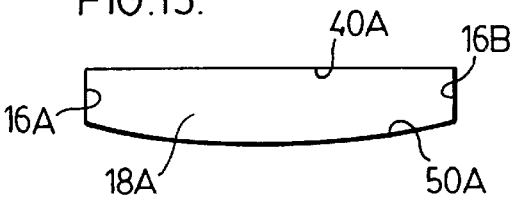
FIG. 15 is a polar cross-sectional view similar to FIG. 12 of the blade of FIG. 1.

The shape of the channels 18 for various embodiments is more clearly illustrated in the cross-sectional views of FIGS. 10 through 15. To understand the planes shown it should be understood that from a mathematical view a plane is any surface defined by two parameters and certain constants. In Cartesian coordinates a plane is flat. However, it is also possible to consider a plane in polar co-ordinates. In polar coordinates a plane is a cylinder. A polar plane is illustrated in FIG. 6 by the dotted line 80 which is concentric with the axis 20. FIGS. 10 and 13 are such polar planes taken at the inlet end of flow channels 18. FIGS. 12 and 15 are taken at the outlet end of flow channel 18 and FIGS. 11 and 13 are taken intermediate the inlet and outlet.

FIGS. 10, 11 and 12 illustrate in polar plane, the cross section of a flow channel 218A for the blade 210 illustrated in FIG. 8. The flow channel 218A is comprised of a portion of the surface 240A, a portion of the surface 250A and surfaces of adjacent pairs of vanes, 216A and 216B. FIG. 12 illustrates the flow channel 218A at the outlet 232. FIG. 10 illustrates the configuration of the flow channel 218A adjacent the inlet 230, and FIG. 11 illustrates the configuration of the flow channel 218A midway between the inlet 230 and the outlets 232. It will be observed from these figures that the width of the surface 250A increases. This follows because the diameter of the wall 214 is considerably larger at the outlet 232 as compared to adjacent the inlet 230. Because the cones have different angles as illustrated in FIG. 8 and the wall 212 has a steeper angle than the wall 214, the height of the flow channel 218A diminishes from the inlet 230 to the outlet 232. If desired, the cone angles may be adjusted, so that the change in cross-sectional area of the flow channel 218A is reduced or eliminated. We have found that this also increases the efficiency as it appears to eliminate unnecessary eddies and turbulence in the fluid flowing in the fluid flow channels 18.

Additional energy savings may be achieved by altering the shape of the polar cross-section of the flow channel 18. In FIGS. 10, 11 and 12 those flow channels are shown as rectangular. Additional savings may be achieved by smoothly concavely contouring one or more of the inner surfaces in the polar plane.

FIG. 13, 14 and 15 are similar to FIGS. 10, 11 and 12 respectively and illustrate the polar plane cross-section views taken of flow channel 18A of the blade 10. The principal difference between FIGS. 13, 14 and 15 on the one hand, and FIGS. 10, 11 and 12 on the other is the configuration of the second internal surface 50A. As shown, the configuration of the surface 50A is a smooth concave curve extending between adjacent vanes 16A and 16B. Additional efficiencies are created, by the curving of the surface 50A as illustrated in FIGS. 13, 14, 15 and FIGS. 1 through 6. Referring now more particularly to FIG. 6, it will be observed that the surface 50 has a generally scalloped configuration so that each of the flow channels 18 has a concave surface, that is, curving outwardly from the interior of the flow channel 18.

FIGS. 10, 11 and 12 all show a polar cross-section for the flow channel 18 which is substantially rectangular in configuration. In FIGS. 13, 14 and 15, the similar polar cross-sectional views show that one surface of the fluid flow channel 10 is smoothly, concavely curved. The precise configuration of the curve may change as desired by the designer and is subject to considerations which will be mentioned below. The use of the terms "smooth" and "concave" is intended to mean in this specification and claims that every element of the curve is concave but that the radius of curvature at any element of the curve can be different. The curves however are smooth curves in that every finite length of the curve is concave over that finite length. Thus the concave curve could be hyperbolic or parabolic for example, or have another or irregular shape. The curve extends from one vane to an adjacent vane. The relative proportions of the curve, that is, from left to right in the views, need not be constant over the length of the fluid flow channel.

Figure 16:
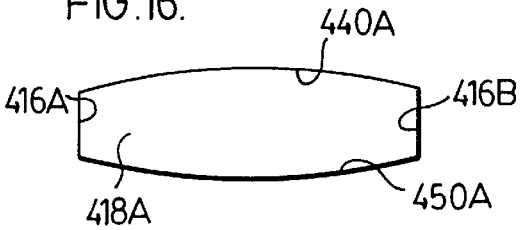
FIG. 16 is a polar cross-sectional view of a portion of the flow channel of a further embodiment.

FIG. 16 is a view similar to the view of FIG. 14. FIG. 16 however involves a further enhanced embodiment of the invention. In FIG. 16, the flow channel 418 is defined by adjacent vanes 416A and 416B as well as by the first internal surface 440A and the second internal surface 450A. In this case, the first internal surface 440A is also smoothly, concavely curved when viewed from the interior of the fluid flow channel 418. The blade having cross-sectional profiles for the fluid flow channels 418 as shown in FIG. 16 would thus have a scalloped appearance for both the first generally conical wall 412 and the second generally conical wall 414.

Figure 17:
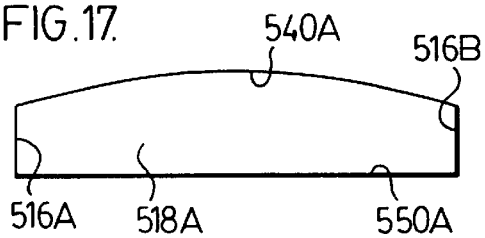
FIG. 17 is a polar cross-sectional view of a portion of the flow channel of a further embodiment.

FIG. 17 is a view similar to FIGS. 15 and 16. In this embodiment, only first inner surface 540A is smoothly concavely contoured and second inner surface 550A is flat in polar cross-section so that the flow channel 518A is formed by surfaces 516A, 516B, and one straight surface 550A and one curved surface 540A.

For purposes of clarity, however, it should be recognized that these two effects, that is, curving in the concave direction and in the convex direction as described herein may be utilized together or separately. The two effects are in different planes and thus an interior surface can show as a straight or curved line in views such as FIGS. 10 through 17 while being either straight or curved in views such as FIGS. 3, 7, 8 and 9.

FIG. 9 may also be considered in a slightly different aspect. From reference to FIG. 6, it will be recognized, that a curved section can be described as marked at line 9—9 in FIG. 6. The curved section as illustrated by the line 9—9 in FIG. 6 presents the same cross-sectional configuration as shown in FIG. 9. The line 340 illustrates the curve of the first interior surface of the conical wall 12. The line 350 represents the surface 50 of the second conical wall 14. The curved plane 9—9 would thus not show the scalloped configuration. Thus, a plane as shown in line 9—9 would illustrate a cross-section as depicted in FIG. 9 for a blade irrespective of whether the wall 12 or the wall 14 or both, have the scalloped configuration as discussed above in connection with FIGS. 13 through 16. Thus, the view of FIG. 9 is pertinent, assuming the section 9—9 in FIG. 6, for the embodiment illustrated in FIGS. 10, 11 and 12, where there is no scalloping of the interior surface 50, FIGS. 13, 14 and 15, where there is scalloping of one of the interior surfaces 40 or 50, and FIG. 16 where there is scalloping of both of the interior surfaces 40 and 50, as long as the surface 340 or 440 is curved in the plane which contains the axis of rotation.

While the scalloped like effect illustrated in FIGS. 10 to 17 will give additional flow efficiencies with regard to flow through the flow channel 418, it is also appropriate to consider other energy losses which may occur in connection with blades of the various embodiments discussed herein. The energy losses can be understood by reference to the embodiment shown in FIGS. 1 through 6.

The first exterior surface 42 will be rotating as the blade rotates, adjacent to the shroud or housing enclosing the blade 10. In order to minimize turbulence which may occur on or adjacent the surface 42, the surface 42 should be smooth. The word smooth in this context is meant to mean that in a plane perpendicular to the axis 20, the surface 12 has no projections or depressions, that is, it is essentially circular. Similarly, the second exterior surface 52 of the wall 14 will be rotating but within the chamber defined by the shroud or housing. There may also be energy losses resulting from turbulence on the second exterior surface 52 and this surface should also be smooth. In addition, a smooth surface reduces flow induced vibration losses. The first and second interior surfaces 40 and 50 respectively, when made in the scalloped shape as shown with respect to surface 50 in FIG. 1, will not have the desired smooth configuration in that plane. Accordingly, if the thickness of the second wall 14 is constant, then the second exterior surface 52 would also be scalloped and would result in wind losses due to turbulence occurring along the surface 52. These losses can be reduced by ensuring that the surface 52 is smooth by varying the thickness of the second wall 14. Because the wind losses arising from turbulence adjacent to surface 52 are relatively small in any event, it may be that an efficient device can be made, given the other efficiencies arising from the configurations described herein, that the surface 52 may be left as a scalloped surface.

With respect to the first exterior surface 42, it is expected that the losses adjacent the surface 42 arising from turbulence on that surface may be more significant. Thus, if the first internal surface 40 is scalloped as shown with respect to surface 440 in FIG. 16, then it is believed that the thickness of the first generally conical wall 12 should vary to provide a smooth surface 42 in the plane referred to above so as to not cause any additional losses through turbulence at the surface 42.

The blade 10 and the alternate embodiments 110, 210, 310 and 410 discussed herein, are relatively complex shapes. Such shapes will be very difficult to make in a single mold step because of the complex shape of the fluid flow channels 18. It is suggested that the most economical way of manufacturing a blade in accordance with this invention is to manufacture a first piece comprising one of the walls 12 or 14 with the vanes 16 formed integrally therewith. By way of example, FIG. 6 illustrates such a proposed first piece comprising the second wall 14 and a series of six vanes 16. The surface 52 can be scalloped, thus having the profiles as shown in FIGS. 13, 14 and 15. A piece of this configuration can be made by injection molding and may be made from any suitable material including metals and suitable plastics. A second piece to be assembled to the piece illustrated in FIG. 6 could then be molded of similar materials and would comprise the first generally conical wall 12. This piece could have convex surfaces 40 and 42 as shown in FIG. 3 or any other or additional curves referred to herein. The attachment area between the two pieces would then be the edge of the plurality of vanes 16, including the flat lands visible in FIG. 6. The two pieces can be permanently affixed to one another by means of adhesives, braising, thermal bonding, welding in the case of meltable materials such as plastics or metals or mechanical joints such as press fits, rivots or other fasteners. Various other means of joining the two parts together may also be used.

Figure 18:
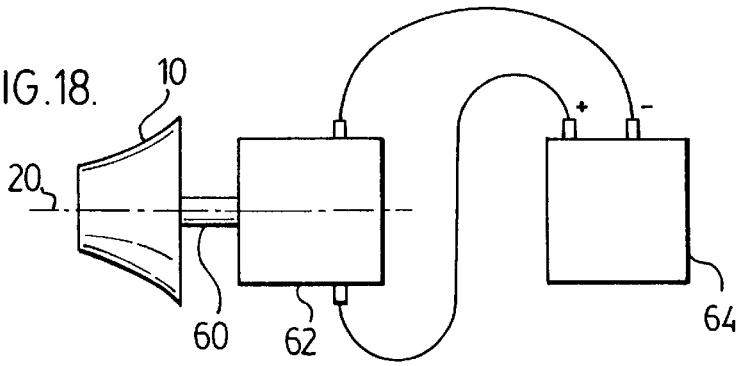
FIG. 18 illustrates the blade of FIG. 1 together with a motor and power source.

FIG. 18 illustrates a blade 10 driven by a drive shaft 60. The drive shaft 60 is driven by a motor 62. The motor 62 is powered from a rechargeable battery 64. Because of the increased efficiency of the blade 10, performance typical of a plug in vacuum cleaner can be obtained from a battery small enough to be carried on a typical residential sized upright vacuum for a period of about one hour between recharge cycles.

Various other modifications may be made to the blades made in accordance with this invention. In particular, the blades described herein are to be considered as illustrative of preferred embodiments of the invention and should not be considered limiting. The full scope of the invention is set out in the attached claims.

We claim:

1. A blade for use with a motor for moving fluid to create a fluid suction device, said blade comprising a generally conical shape, said blade comprising a first generally conical wall having a first inner surface and a first outer surface and said blade comprising a second generally conical wall, having a second inner surface and a second outer surface, said blade further comprising a plurality of vanes extending between said first and second walls to define a plurality of fluid flow channels between said first generally conical wall and said second generally conical wall and adjacent pairs of said vanes, and wherein said first and second generally conical walls have a common general axis of rotation, said blade having a fluid inlet for said plurality of fluid flow channels located substantially on said axis, said blade having a fluid outlet for said plurality of fluid flow channels, which outlet is located radially outwardly of said axis of rotation, and which outlet is located axially spaced from said inlet with respect to said axis, so that fluid flowing in said fluid flow channels moves radially outwardly and axially along with respect to said axis, and said fluid flow channels are defined by said first inner surface and said second inner surface wherein at least one of said first inner surface and said second inner surface is curved in a plane which contains said axis, at least one of said fluid flow channels is defined by a portion of said first inner surface and a portion of said second inner surface, and two adjacent vanes, and wherein at least one of said first inner surface and said second inner surface is curved in a polar plane relative to said axis and said curve is concave when viewed from the interior of said fluid flow channel.

2. The blade of claim 1 wherein said second interior surface is curved in said polar plane.

3. The blade of claim 1 wherein the first interior surface is curved in said polar plane.

4. The blade of claim 3 wherein both said first and second interior surfaces are curved in said polar planes.

5. The blade of claim 4 in which said first interior surface is curved in a plane containing said axis.

6. The blade of claim 3 wherein said blade is driven by a motor and said motor is battery powered.

7. A blade for use with a motor for moving fluid comprising a generally conical shape, said blade comprising a first generally conical wall having a first inner surface and a first outer surface, said blade comprising a second generally conical wall having a second inner surface and a second outer surface, said blade comprising a plurality of vanes extending between said first and second walls to define a plurality of fluid flow channels between said inner and outer walls and pairs of said vanes, and wherein, said first and second generally conical walls have a common general axis of rotation, said blade having a fluid inlet for said plurality of fluid flow channels which is located substantially on said axis, said blade having a fluid outlet for said plurality of fluid flow channels which is located radially outwardly of said axis and which is located axially spaced from said inlet with respect to said axis, so that fluid flowing in said fluid flow channels moves radially outwardly and axially along with respect to said axis and wherein at least one of said first inner surface and said second inner surface is curved in a plane containing said axis, wherein said first inner surface is curved in said plane containing said axis, at least one of said fluid flow channels is defined by a portion of said first interior surface and a portion of said second interior surface, and two adjacent vanes, and wherein at least one of said first inner surface and said second inner surface is curved in a polar plane relative to said axis and said curve is concave when viewed from the interior of said fluid flow channel.

8. The blade of claim 7 wherein said second interior surface is curved in said polar plane.

9. The blade of claim 8 wherein the first interior surface is curved in said polar plane.

10. The blade of claim 9 wherein both said first and second interior surfaces are curved in said polar planes.

11. A blade for use with a motor for moving fluid comprising a generally conical shape, said blade comprising a first generally conical wall having a first inner surface and a first outer surface, said blade comprising a second generally conical wall having a second inner surface and a second outer surface, said blade comprising a plurality of vanes extending between said first and second walls to define a plurality of fluid flow channels between said first and second walls and pairs of said vanes, and wherein, said first and second generally conical walls have a common general axis of rotation, said blade having a fluid inlet for said plurality of fluid flow channels which is located substantially on said axis, said blade having a fluid outlet for said plurality of fluid flow channels which is located radially outwardly of said axis and which is located axially spaced from said inlet with respect to said axis, so that fluid flowing in said fluid flow channels moves radially outwardly and axially along with respect to said axis and wherein at least one of said first inner surface and said second inner surface is curved in a polar plane relative to said axis and said curve is concave when viewed from the interior of said fluid flow channels.

12. The blade of claim 11 wherein said second interior surface is curved in said polar plane.

13. The blade of claim 12 wherein the first interior surface is curved in said polar plane.

14. The blade of claim 13 wherein both said first and second interior surfaces are curved in said polar planes.

15. The blade of claim 14 in which said first interior surface is curved in a plane containing said axis.

16. The blade of claim 11 wherein said surface which is curved in said polar plane extends from a first one of said vanes to the next adjacent vane.

* * * * *